US008840381B2

(12) United States Patent
Fukasaku et al.

(10) Patent No.: US 8,840,381 B2
(45) Date of Patent: Sep. 23, 2014

(54) ELECTRIC COMPRESSOR

(75) Inventors: Hiroshi Fukasaku, Kariya (JP); Hiroyuki Gennami, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 68 days.

(21) Appl. No.: 13/411,860

(22) Filed: Mar. 5, 2012

(65) Prior Publication Data

US 2012/0230851 A1 Sep. 13, 2012

(30) Foreign Application Priority Data

Mar. 8, 2011 (JP) ..... 2011-050007

(51) Int. Cl.

| | |
|---|---|
| ***F04B 17/03*** | (2006.01) |
| ***F04B 35/04*** | (2006.01) |
| ***F04C 23/00*** | (2006.01) |
| ***F04C 18/02*** | (2006.01) |

(52) U.S. Cl.

CPC ..... *F04C 23/008* (2013.01); *F04C 2240/803* (2013.01); *F04C 18/0215* (2013.01); *F04B 35/04* (2013.01)

USPC ..... 417/423.7; 310/71

(58) Field of Classification Search

USPC ..... 417/410.1, 410.5, 423.7; 439/382–385, 439/353, 357; 310/51, 71

See application file for complete search history.

(56) References Cited

U.S. PATENT DOCUMENTS

| | | | | |
|---|---|---|---|---|
| 4,964,788 | A | 10/1990 | Itameri-Kinter et al. | |
| 5,629,574 | A | 5/1997 | Cognetti et al. | |
| 2001/0005659 | A1* | 6/2001 | Fukumoto et al. | 439/892 |
| 2003/0234115 | A1 | 12/2003 | Deng et al. | |
| 2008/0067884 | A1 | 3/2008 | Handwerker | |
| 2008/0116838 | A1 | 5/2008 | Hattori et al. | |
| 2009/0162222 | A1 | 6/2009 | Iguchi et al. | |
| 2009/0315418 | A1 | 12/2009 | Hasegawa | |
| 2010/0143165 | A1 | 6/2010 | Itabashi et al. | |
| 2011/0020153 | A1 | 1/2011 | Murakami | |
| 2011/0158833 | A1* | 6/2011 | Murakami et al. | 417/422 |

FOREIGN PATENT DOCUMENTS

| | | | |
|---|---|---|---|
| CN | 101187364 | A | 5/2008 |
| CN | 101463821 | A | 6/2009 |
| CN | 101490415 | A | 7/2009 |
| CN | 101622450 | A | 1/2010 |

(Continued)

OTHER PUBLICATIONS

Notice of Allowance for U.S. Appl. No. 13/411,850 mailed Aug. 22, 2013.

(Continued)

*Primary Examiner* — Bryan Lettman
(74) *Attorney, Agent, or Firm* — Sughrue Mion, PLLC

(57) ABSTRACT

An electric compressor including a compression mechanism, an electric motor, an inverter, a compressor housing, a sealed terminal, a cluster block, and a metal brace. The sealed terminal is arranged in the compressor housing and electrically connects the inverter and the electric motor. Further, the sealed terminal includes a terminal pin, which is formed from a conductive material, a terminal holder, and an insulative body. The cluster block includes an insertion hole into which the terminal pin is inserted. The metal brace electrically connects the terminal pin to the lead wire. The cluster block includes a protrusion projecting around the insertion hole and surrounding part of the insulative body. The insertion hole has an inside diameter larger than an outside diameter of the terminal pin.

5 Claims, 3 Drawing Sheets

(56) References Cited

FOREIGN PATENT DOCUMENTS

| | | | | | |
|---|---|---|---|---|---|
| CN | 101666303 | A | | 3/2010 | |
| JP | 63-230972 | A | | 7/1988 | |
| JP | 5-312150 | A | | 11/1993 | |
| JP | 2001-182655 | A | | 7/2001 | |
| JP | 2003-214340 | A | | 7/2003 | |
| JP | 2005-307798 | A | | 11/2005 | |
| JP | 2005-337159 | A | | 12/2005 | |
| JP | 2007-170252 | A | | 7/2007 | |
| JP | 2007-278184 | A | | 10/2007 | |
| JP | 2010-1882 | A | | 1/2010 | |
| JP | 2010-168914 | A | | 8/2010 | |
| WO | WO2010024021 | | * | 3/2010 | ..... F04B 39/00 |

OTHER PUBLICATIONS

Office Action issued on Apr. 1, 2014 in Chinese Patent Application No. 201210057395 X.

Office Action issued on Mar. 25, 2014 in Chinese Patent Application No. 201210056987 X.

* cited by examiner

ELECTRIC COMPRESSOR

BACKGROUND OF THE INVENTION

The present invention relates to an electric compressor including an electric motor, and more particularly, to a sealed terminal connected to a lead wire of an electric motor.

An electric compressor includes an electric motor, which is accommodated in a sealed compressor housing. A sealed terminal is arranged on the compressor housing to electrically connect a lead wire of the electric motor and an inverter, which is arranged outside the compressor housing to drive the electric motor. The sealed terminal includes a terminal pin, which is formed from a conductive material, and a metal terminal holder, which holds the terminal pin. An insulative material, such as a ceramic or glass, is arranged between the terminal pin and the terminal holder.

Japanese Laid-Open Patent Publication No. 2010-1882 discloses an electric compressor that accommodates an electric motor and a compression mechanism, which is driven by the electric motor, in a motor housing. A platform is arranged on an outer surface of the motor housing. An inverter is arranged on the platform to convert DC power, which is supplied from outside the electric compressor, into three-phase AC power and control the rotation speed of the electric motor. A through hole extends through the motor housing in front of the inverter. A sealed terminal is arranged in the through hole. The sealed terminal includes a terminal body and a conductive member, which is formed from a metal and extends through a hole arranged in the terminal body. Insulative adhesive is applied to the conductive member at a portion located inside the hole of the terminal body. This fixes the terminal body and the conductive body integrally with each other.

At the lower side of the terminal body, a side wall of the terminal body has an edge that projects into the motor housing and forms a flange, which extends outward. The terminal body includes a portion located in the through hole of the motor housing. A groove extends throughout the entire circumference of this portion. An O-ring, which serves as a sealing means, is arranged in the groove. The O-ring seals the inner side of the motor housing from an inverter accommodation compartment, which is the outer side of the motor housing. This seals the motor housing. A cluster block, which electrically connects the sealed terminal to the electric motor, is arranged under the sealed terminal. The cluster block is spaced apart from the sealed terminal. The lower end of the conductive member extends into the cluster block through a hole arranged in a top surface of the cluster block and is electrically connected by a connection terminal and lead wire to the electric motor.

In a structure in which the cluster block is spaced apart from the sealed terminal like in the above publication, the cluster block and sealed terminal can be freely laid out. Thus, there is no need for a special fastening means. This is advantageous since the structure in the motor housing is simpler than a structure that arranges the cluster block in contact with the sealed terminal.

However, a refrigerant freely circulates between the sealed terminal and the cluster block. This causes various problems. For example, fine particles produced by wear of the interior of the electric compressor and pipes, which form an external refrigerant circuit, are suspended in the refrigerant circulating through the electric compressor. The particles may include relatively elongated particles that are caught and collected on the terminal body of the sealed terminal, the exposed connection terminal, or near the through hole for the sealed terminal in the motor housing. Collected elongated particles may cause contact and short-circuiting between the connection terminal and one or both of the terminal body and motor housing. As a result, electricity may leak to the motor housing of the electric compressor.

For example, in a scroll type electric compressor, a large amount of abrasive particles produced when wear occurs in a metal plating of a scroll and in metal members inside the electric compressor and of an outer refrigerant circuit may be suspended in the circulating refrigerant. When, for example, a sealed terminal includes a terminal body fixed by a ceramic insulator to a connection terminal, the ceramic insulator is exposed to the circulating refrigerant. As a result, a large amount of the abrasive particles suspended in the refrigerant are apt to entering and collecting in fine pores of the ceramic insulator. The abrasive particles deposited on the connection terminal may cause short-circuiting between the connection terminal and the terminal body. As a result, electricity may leak to the motor housing of the electric compressor.

SUMMARY OF THE INVENTION

It is an object of the present invention to provide an electric compressor that prevents short-circuiting between a terminal pin and one or both of a terminal holder and housing.

One aspect of the present invention is an electric compressor including a compression mechanism. An electric motor drives the compression mechanism. The electric motor is connected to a lead wire. An inverter drives the electric motor. A compressor housing accommodates the electric motor and the compression mechanism. A sealed terminal is arranged in the compressor housing and electrically connects the inverter and the electric motor. The sealed terminal includes a terminal pin, which is formed from a conductive material, a terminal holder, which holds the terminal pin, and an insulative body, which insulates the terminal pin from the terminal holder. A cluster block is arranged inside the compressor housing and includes an insertion hole into which the terminal pin is inserted. A metal brace is arranged inside the cluster block and electrically connects the terminal pin to the lead wire. The cluster block includes a protrusion projecting around the insertion hole and surrounding part of the insulative body. The insertion hole has a larger diameter than the terminal pin.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
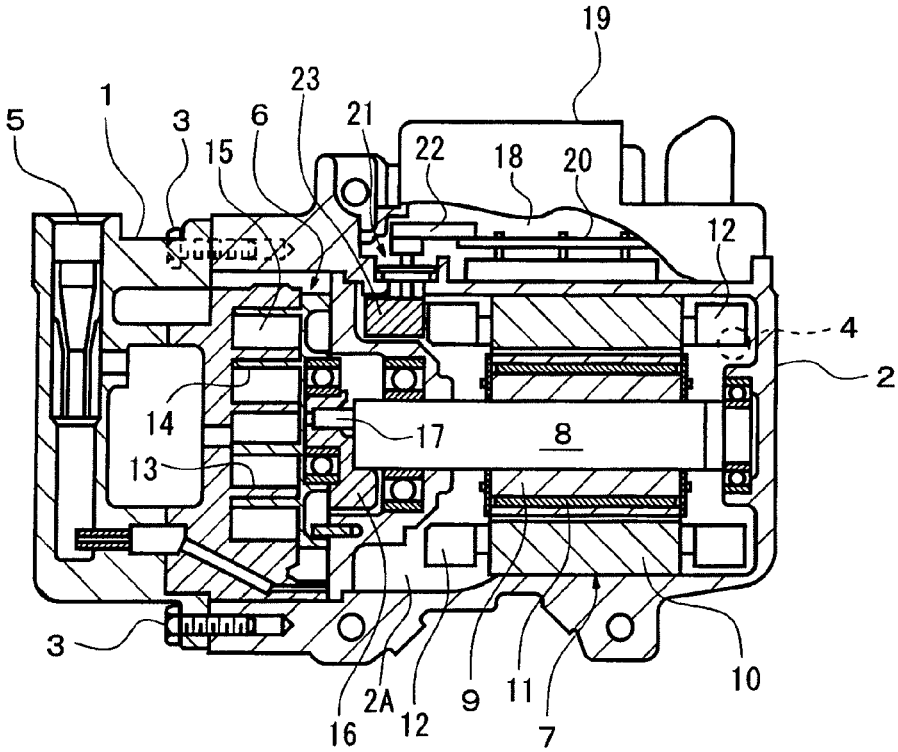
FIG. 1 is a cross-sectional diagram of a scroll type electric compressor according to a first embodiment of the present invention.

A first embodiment will now be described with reference to FIGS. 1 to 5. FIG. 1 shows a scroll type electric compressor including a sealed compressor housing, which is formed by integrally joining a front housing member 1 and a rear housing member 2 with a plurality of bolts 3. The housing members 1 and 2 are both formed from a metal material such as aluminum or aluminum alloy. The housing member 2 includes a suction port 4. The housing member 1 includes a discharge port 5. The suction port 4 and discharge port 5 are connected to an external refrigerant circuit (not shown).

The housing members 1 and 2 define an interior 2A that accommodates a scroll type compression mechanism 6 and an electric motor 7, which drives the compression mechanism 6. The electric motor 7 includes a rotation shaft 8, a rotor 9, and a stator 10. The rotation shaft 8 is held by bearings to be rotatable in the housing member 2. The rotor 9 is fixed to the rotation shaft 8. The stator 10 is arranged outside the rotor 9 and fixed to an inner wall of the housing member 2. The rotor 9 includes a plurality of permanent magnets 11. The stator 10 includes coils 12 wound in three phases.

Main elements of the compression mechanism 6 include a fixed scroll 13, which is fixed to inner walls of the housing members 1 and 2, and a movable scroll 14, which is arranged facing the fixed scroll 13. A compression chamber 15 having a variable volume is defined between the fixed scroll 13 and movable scroll 14 to compress refrigerant. The movable scroll 14 is coupled by a bearing and an eccentric bushing 16 to an eccentric pin 17 of the rotation shaft 8. Thus, when the rotation shaft 8 rotates, the movable scroll 14 orbits (revolves) about the axis of the rotation shaft 8 thereby varying the volume of the compression chamber 15.

An inverter housing 19, which defines an inverter accommodation compartment 18, is fixed to part of the outer wall of the housing member 2. In the inverter accommodation compartment 18, an inverter 20, which functions to drive the electric motor 7, and a sealed terminal 21 are coupled to the outer wall of the housing member 2. The sealed terminal 21 is electrically connected by an inverter connector 22 to the inverter 20 in the inverter accommodation compartment 18. Further, the sealed terminal 21 is electrically connected to lead wires 24 (refer to FIG. 4) that extend from the coils 12 of the stator 10 through a cluster block 23 in the interior 2A of the housing member 2. Accordingly, when current is supplied from the inverter 20 via the sealed terminal 21 to the coils 12 of the electric motor 7, the rotor 9 is rotated, and the rotation shaft 8 actuates the compression mechanism 6.

Figure 2:
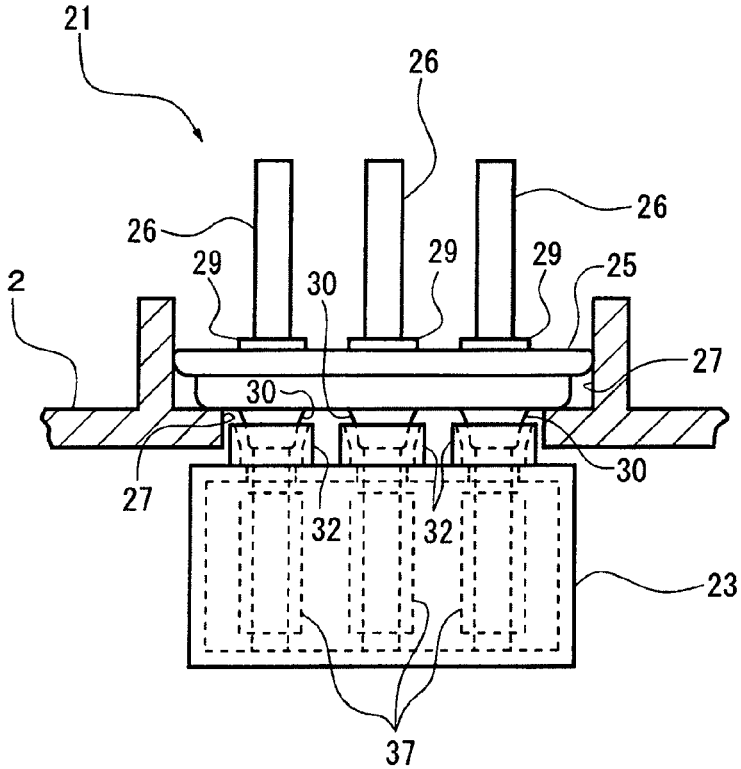
FIG. 2 is a front view showing the relationship of a sealed terminal and cluster block of FIG. 1.
Figure 3:
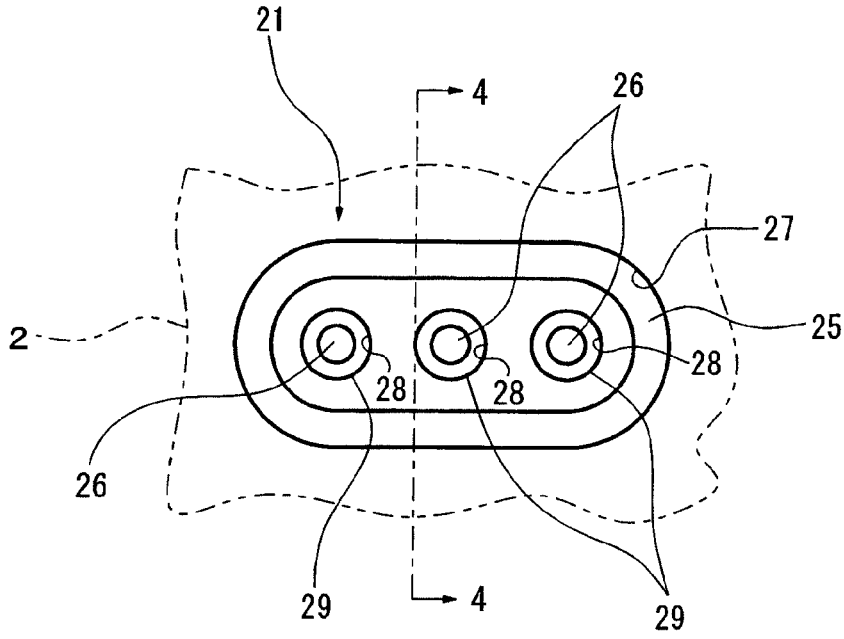
FIG. 3 is a plan view showing the sealed terminal of FIG. 2.
Figure 4:
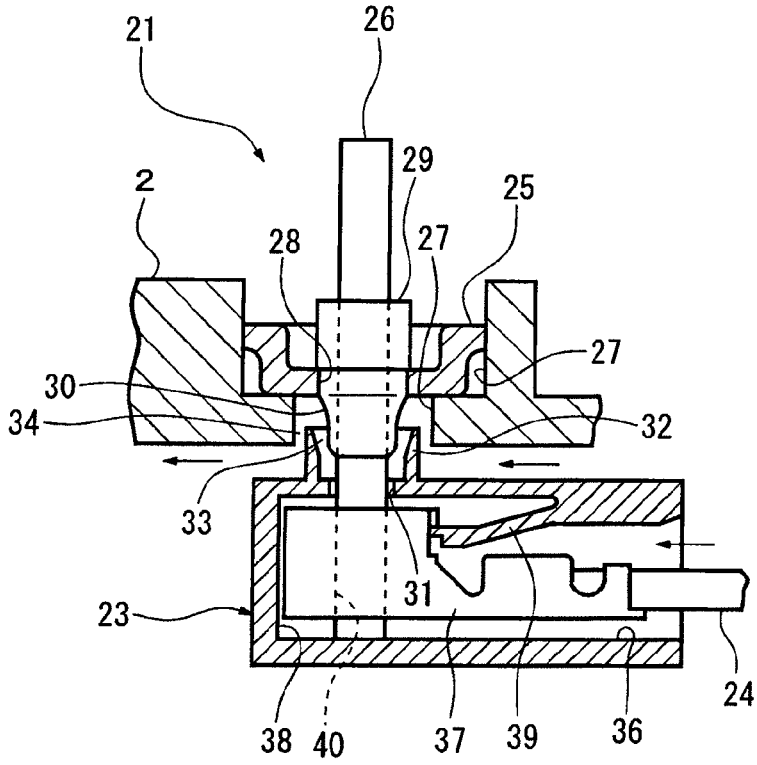
FIG. 4 is a cross-sectional view taken along line 4-4 in FIG. 3.

As shown in FIGS. 2 to 4, the sealed terminal 21 includes an elongated bowl-shaped terminal holder 25 and three rod-shaped terminal pins 26, which correspond to the three-phase coils 12 of the electric motor 7. The terminal holder 25 is arranged in and fixed to a coupling opening 27 (refer to FIG. 4) of the housing member 2 by an O-ring and a snap ring (not shown) so as to hermetically seal the housing member 2. The sealed terminal 21 is electrically connected by the connector 22, which is arranged above the sealed terminal 21, to the inverter 20, which is arranged in the inverter accommodation compartment 18 outside the housing member 2. Further, the sealed terminal 21 is electrically connected by the cluster block 23, which is arranged below and spaced apart from the sealed terminal 21, to the electric motor 7, which is arranged in the interior 2A of the sealed housing member 2, while maintaining the housing member 2 in the sealed state.

The terminal holder 25 is formed from a metal material, such as steel, and includes three holes 28 (refer to FIGS. 3 and 4). Each terminal pin 26 is formed from a conductive material and inserted into a corresponding one of the holes 28 in the terminal holder 25. The terminal pin 26 is held in the corresponding hole 28 by a first insulative body 29, which is arranged in the inverter accommodation compartment 18, and a second insulative body 30, which is arranged in the interior 2A of the housing member 2.

The first insulative body 29 is formed from a ceramic oxide, such as zirconia, or other types of ceramic, and fixed to the corresponding terminal pin 26. The second insulative body 30 is formed from glass and fixed to the corresponding terminal pin 26 through fusion or other means.

Figure 5:
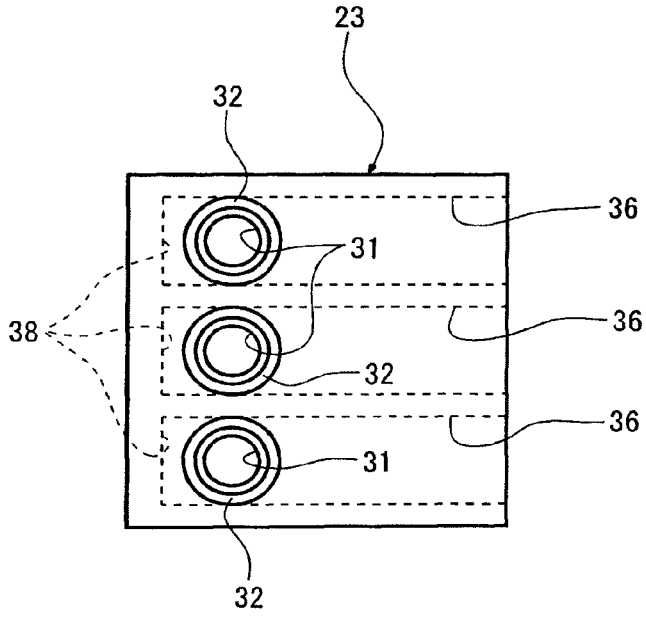
FIG. 5 is a plan view showing the cluster block of FIG. 1.

Referring to FIGS. 4 and 5, the cluster block 23 is formed by a tetragonal box, which is made of an insulative material such as resin. Three insertion holes 31 extend through the upper surface of the cluster block 23 in correspondence with the terminal pins 26. Each insertion hole 31 has an inside diameter that is set to be larger than an outside diameter of the corresponding terminal pin 26. Further, an annular protrusion 32 is formed around each insertion hole 31. As shown in FIG. 4, in a state in which the terminal pins 26 are inserted into the insertion holes 31, each protrusion 32 projects into an area between an inner periphery of the coupling opening 27 and the corresponding second insulative body 30. This forms two gaps 33 and 34, which are in communication with each other and partitioned by the protrusion 32. The gap 33 is formed between the inner surface of the protrusion 32 and the second insulative body 30. The gap 34 is formed between the outer surface of the protrusion 32 and the inner periphery of the coupling opening 27. Accordingly, the protrusions 32 form a labyrinth mechanism, or labyrinth structure, including the two gaps 33 and 34, which are separated from each other, between the inner periphery of the coupling opening 27 and each second insulative body 30. The labyrinth mechanism significantly suppresses the circulation of refrigerant and foreign matter.

The cluster block 23 includes three insertion passages 36 extending in a direction intersecting the insertion holes 31, respectively. Each insertion passage 36 has one end that opens at an edge (right edge as viewed in FIG. 5) of the cluster block 23 and another end that is in communication with the corresponding insertion hole 31. Each end of the three lead wires 24 extending from the coils 12 of the electric motor 7 is fixed to a metal brace 37, which is conductive (refer to FIG. 4). Each metal brace 37 is inserted into the corresponding insertion passage 36. The metal braces 37 are inserted into the insertion passages 36 and positioned by an inner wall 38 (left wall as viewed in FIG. 5) of the cluster block 23 near the insertion holes 31. In this state, a resilient restriction piece 39 fixes each metal brace 37 in the corresponding insertion passage 36. The restriction piece 39 prevents separation of the metal brace 37 from the insertion passage 36. A connection hole 40 extends through the distal end of the metal brace 37, which is covered by the cluster block 23. Each terminal pin 26, when inserted into the insertion hole 31, has a lower end inserted through the connection hole 40 of the corresponding metal brace 37. The lower end of the terminal pin 26 is fastened to the metal brace 37. This electrically connects the terminal pin 26 to the corresponding lead wire 24.

The electric compressor of the first embodiment has the advantages described below.

During operation of the electric compressor, the refrigerant drawn through the suction port 4 circulates from the electric motor 7 to the compression mechanism 6, which compresses the refrigerant. The compressed refrigerant is then sent through the discharge port 5 to the external refrigerant circuit (not shown). Accordingly, the cluster block 23 and part of the sealed terminal 21 that are arranged in the interior 2A of the housing member 2 are constantly exposed to the refrigerant flowing in the direction indicated by the arrows in FIG. 4.

However, the protrusions 32 are arranged around the second insulative bodies 30 of the terminal pins 26 and extend in a direction intersecting, or perpendicular to, the direction in which the refrigerant flows to form the labyrinth mechanism. This suppresses the flow of refrigerant into the gaps 33 and 34 formed around the second insulative bodies 30. Thus, elongated particles suspended in the circulating refrigerant are not caught and collected between the sealed terminal 21 and the cluster block 23. This ensures the prevention of short-circuiting, which would be caused by elongated particles, between the terminal pins 26 and the terminal holder 25 or housing member 2.

Even when the refrigerant includes a large amount of refrigerant, the protrusions 32 obstruct the flow of refrigerant. Further, the labyrinth mechanism suppresses the circulation of refrigerant near the second insulative bodies 30. This prevents abrasive particles from reaching the second insulative bodies 30. Even if abrasive particles are included in the slight amount of refrigerant that enters the gaps 33 and 34, the abrasive particles are apt to moving out of the gaps 33 and 34 from positions opposite to where the abrasive particles entered the gaps 33 and 34 and from between inner peripheries of the insertion holes 31 and the corresponding terminal pins 26. This minimizes the possibility of abrasive grains remaining in the vicinity of each second insulative body 30. Thus, short-circuiting between the terminal holder 25 and terminal pins 26 that would be caused by the collection and deposition of abrasive grains does not occur.

In particular, the second insulative bodies 30 are formed from glass and thus do not collect abrasive particles. Thus, the second insulative bodies 30, in combination with the labyrinth mechanism formed by the protrusions 32, ensure prevention of short-circuiting between the terminal holder 25 and the terminal pins 26.

Figure 6:
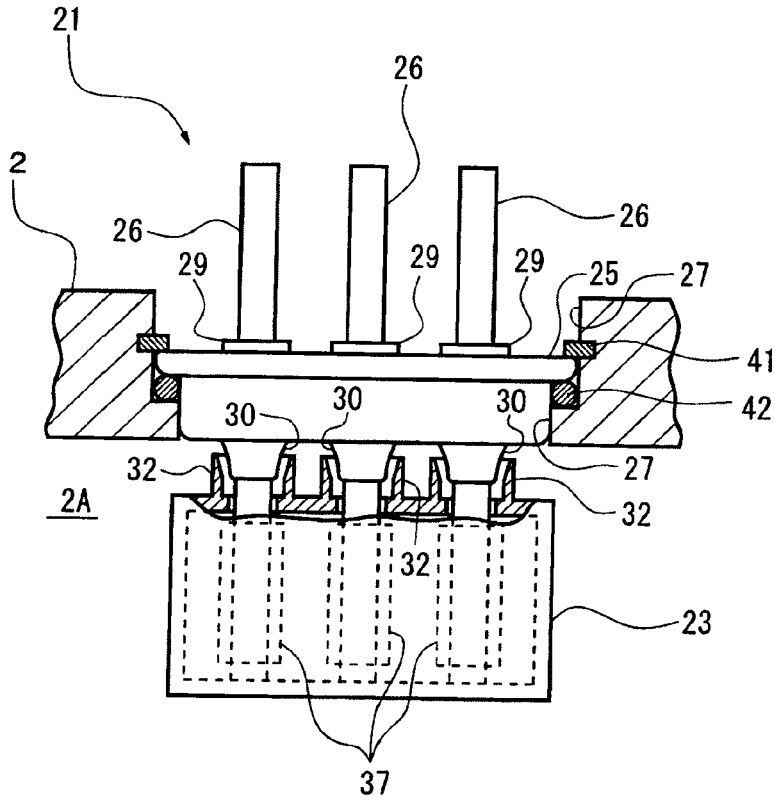
FIG. 6 is a front view, partially in cross-section, showing the relationship between a sealed terminal and cluster block in a second embodiment of the present invention.

FIG. 6 shows a second embodiment of the present invention. In the second embodiment, like or same reference numerals are given to those components that are the same as the corresponding components of the first embodiment. Such components will not be described in detail. In the second embodiment, the sealed terminal 21 is coupled to the coupling opening 27 and arranged so that the terminal holder 25 is directly exposed to the interior 2A of the housing member 2. Thus, the second insulative bodies 30 of the terminal pins 26 are projected into the interior 2A of the housing member 2. When the terminal pins 26 are inserted into the insertion holes 31 of the cluster block 23 (refer to FIG. 4) and connected to the metal braces 37 of the lead wires 24 (refer to FIG. 4), the protrusions 32 formed on the cluster block 23 surround the corresponding second insulative bodies 30. Reference character 41 denotes an O-ring, which was not illustrated in the first embodiment. The O-ring 41 seals the interior 2A of the housing member 2 from the inverter accommodation compartment 18 (refer to FIG. 1). This keeps the interior 2A of the housing member 2 hermetically sealed. Reference character 42 denotes a snap ring that fixes the sealed terminal 21 to the coupling opening 27 of the housing member 2.

Each protrusion 32 covers the surrounding of the corresponding second insulative body 30. Thus, during operation of the electric compressor, the refrigerant drawn through the suction port 4 (refer to FIG. 1) and flowing toward the compression mechanism 6 (refer to FIG. 1) detours the protrusions 32. Accordingly, elongated particles suspended in the refrigerant are not caught by terminal pins 26 and the portion of the housing member 2 near the terminal pins 26. Further, the collection of abrasive grains on the second insulative bodies 30 is prevented. In the same manner as the first embodiment, the second embodiment ensures the prevention of short-circuiting, which would be caused by elongated particles or abrasive particles, between the terminal pins 26 and the terminal holder 25 or housing member 2.

It should be apparent to those skilled in the art that the present invention may be embodied in many other specific forms without departing from the spirit or scope of the invention. Particularly, it should be understood that the present invention may be embodied in the following forms.

(1) In the first embodiment, the first insulative bodies 29 are formed from ceramic and the second insulative bodies 30 are formed from glass. However, in the present invention, the first and second insulative bodies 29 and 30 may both be formed from ceramic or glass.

(2) The protrusions 32 do not have to be circular and may be polygonal or elliptic.

(3) The cluster block 23 does not have to be tetragonal and may have any of a variety of shapes.

(4) In the first embodiment, the three terminal pins 26 are fixed to the single terminal holder 25. However, the terminal holder 25 may be provided for each of the three terminal pins 26 so that a single terminal pin 26 is fixed to each terminal holder.

(5) The terminal holder 25 does not need to have an elongated shape as shown in FIGS. 2 to 4 and may have any of a variety of shapes.

(6) In the first embodiment, the present invention is applied to a scroll type electric compressor. However, the electric compressor that includes an electric motor may be of a different rotary type compressor, such as vane type compressor and a screw type compressor, or a reciprocation type compressor, such as a swash type compressor and a wobble type compressor.

The present examples and embodiments are to be considered as illustrative and not restrictive, and the invention is not to be limited to the details given herein, but may be modified within the scope and equivalence of the appended claims.

The invention claimed is:

1. An electric compressor comprising:

a compression mechanism;

an electric motor that drives the compression mechanism, wherein the electric motor is connected to a lead wire;

an inverter that drives the electric motor;

a compressor housing that accommodates the electric motor and the compression mechanism;

a sealed terminal arranged in the compressor housing and electrically connecting the inverter and the electric motor, wherein the sealed terminal includes a terminal pin, which is formed from a conductive material, a terminal holder, which holds the terminal pin, and an insulative body, which insulates the terminal pin from the terminal holder;

a cluster block arranged inside the compressor housing and including an insertion hole into which the terminal pin is inserted;

and a metal brace arranged inside the cluster block and electrically connecting the terminal pin to the lead wire, wherein the cluster block includes a protrusion projecting around the insertion hole and surrounding part of the insulative body to form a gap between an inner surface of the protrusion and the insulative body, and the insertion hole has an inside diameter larger than an outside diameter of the terminal pin.

2. The electric compressor according to claim 1, wherein the compressor housing includes a coupling hole sealed by the sealed terminal, and at least part of the protrusion is arranged in an area surrounded by an inner periphery of the coupling hole.

3. The electric compressor according to claim 2, wherein a second gap is formed between an outer surface of the protrusion and the inner periphery of the coupling hole, wherein the second gap is in communication with the gap between the inner surface of the protrusion and the insulative body.

4. The electric compressor according to claim 1, wherein the projection extends in a direction intersecting a direction in which refrigerant flows in the compressor housing.

5. The electric compressor according to claim 1, wherein the insulative body of the terminal pin includes a first insulative body, which is arranged outside the compressor housing and formed from ceramic, and a second insulative body, which is arranged inside the compressor housing and formed from glass.

* * * * *